US009957846B2

(12) United States Patent
Miyazawa et al.

(10) Patent No.: US 9,957,846 B2
(45) Date of Patent: May 1, 2018

(54) LIFTER STRUCTURE

(71) Applicant: OTICS CORPORATION, Nishio-shi, Aichi (JP)

(72) Inventors: Daiki Miyazawa, Nishio (JP); Kimihiko Todo, Nishio (JP); Tatsuya Sasaki, Nishio (JP)

(73) Assignee: OTICS CORPORATION, Nishio-Shi, Aichi (JP)

( * ) Notice: Subject to any disclaimer, the term of this patent is extended or adjusted under 35 U.S.C. 154(b) by 139 days.

(21) Appl. No.: 15/081,143

(22) Filed: Mar. 25, 2016

(65) Prior Publication Data

US 2016/0290177 A1 Oct. 6, 2016

(30) Foreign Application Priority Data

Mar. 31, 2015 (JP) ..... 2015-072098

(51) Int. Cl.
*F01L 1/14* (2006.01)
*F02M 59/10* (2006.01)

(52) U.S. Cl.
CPC ..... *F01L 1/14* (2013.01); *F01L 1/143* (2013.01); *F01L 1/146* (2013.01); *F01L 2105/00* (2013.01); *F01L 2107/00* (2013.01); *F02M 59/102* (2013.01)

(58) Field of Classification Search
CPC ..... F01L 1/14; F01L 2017/00; F01L 2105/00; F01L 2107/00; F02M 59/102
USPC ..... 123/90.48, 90.5
See application file for complete search history.

(56) References Cited

U.S. PATENT DOCUMENTS

2010/0294219 A1 11/2010 Prokop

FOREIGN PATENT DOCUMENTS

| | | | |
|---|---|---|---|
| DE | 10 2006 059716 | A | 6/2008 |
| JP | H03-52307 | U | 5/1991 |
| JP | H10-280929 | A | 10/1998 |
| JP | 2001-140609 | A | 5/2001 |
| JP | 2012-002115 | A | 1/2012 |

OTHER PUBLICATIONS

European Search Report dated Aug. 25, 2016 in European Patent Application No. 16 000 527.8 (8 pages).

*Primary Examiner* — Ching Chang
(74) *Attorney, Agent, or Firm* — Smith, Gambrell and Russell, LLP

(57) ABSTRACT

A lifter structure includes a cylindrical member configured to be reciprocally slid in a guide hole of a lifter guide according to rotation of a cam and having an engagement groove and a rotation-preventing member which is separate from the cylindrical member and is disposed so as to face an interior of the guide hole. The rotation-preventing member is inserted into the engagement groove to abut against a groove edge of the engagement groove in a rotation direction of the cylindrical member, thereby preventing the cylindrical member from rotation in the guide hole.

5 Claims, 3 Drawing Sheets

LIFTER STRUCTURE

CROSS-REFERENCE TO RELATED APPLICATIONS

This application is based upon and claims the benefit of priority from the prior Japanese Patent Application No. 2015-72098 filed on Mar. 31, 2015, the entire contents of which are incorporated herein by reference.

BACKGROUND

1. Technical Field

The present invention relates to a lifter structure including a reciprocally slidable cylindrical member provided in a guide hole of a lifter guide.

2. Related Art

Japanese Patent Application Publication No. JP-A-2012-2115 discloses a lifter structure which is suitable for use with an internal combustion engine such as automobile engines. The disclosed lifter structure includes a lifter body and a roller which abuts against a cam thereby to be pressed. The lifter body includes a cylindrical portion having an outer periphery reciprocally slidable on an inner periphery of a cylinder (a lifter guide) and a pair of supports formed to be connected to one end side of the cylindrical portion. A shaft support pin has two ends fixed to the supports respectively. The roller is rotatably supported on the shaft support pin.

The cylindrical portion has a stopper formed integrally with the one end thereof and preventing rotation of the lifter body. The stopper is slidably fitted into a stop groove recessed in the inner periphery of the cylinder.

In the lifter structure of the above-described type, a predetermined gap is defined between the outer periphery of the cylindrical portion and the inner periphery of the cylinder in order that a smooth reciprocal movement of the lifter body may be secured. The lifter body is sometimes tilted within the range of the gap when pressed by the cam. If the lifter body is tilted to a large degree, diagonal corners of the cylindrical portion are brought into biased contact with the inner periphery of the cylinder (what is called cocking phenomena) with the result that an abnormal noise is produced and there is a possibility that the cylinder may be worn by sliding.

In view the above-described problem, if the cylindrical portion is extended in the reciprocal direction so that the reciprocal sliding distance is increased, the cylindrical portion would be unlikely to tilt in the cylinder and the cocking could be reduced. In this case, however, the stopper is located at the end of the cylindrical portion in the extension direction. Accordingly, consideration should be made to prevent the stopper from intruding into a rotation locus, with the result that a sufficient sliding distance cannot be ensured.

Furthermore, since the stopper integrally protrudes outside the cylindrical portion, it is difficult to feed the cylindrical portions in one way for continuous processing in a feedthrough manner when outer peripheries of the cylindrical portions are ground in a finish processing.

SUMMARY

Therefore, an object of the invention is to provide a lifter structure which can increase a sliding length and can render the finish processing easier.

The invention provides a lifter structure including a cylindrical member and a rotation-preventing member. The cylindrical member is configured to be reciprocally slid in a guide hole of a lifter guide according to rotation of a cam. The cylindrical member has an engagement groove. The rotation-preventing member is separate from the cylindrical member and is disposed so as to face an interior of the guide hole. The rotation-preventing member is inserted into the engagement groove to abut against a groove edge of the engagement groove in a rotation direction of the cylindrical member, thereby preventing the cylindrical member from rotation in the guide hole.

The cylindrical member is prevented from rotation in the guide hole by the rotation-preventing member inserted into the engagement groove of the cylindrical member. In this case, since the cylindrical member is separate from the rotation-preventing member, the rotation-preventing member can be configured not to protrude from an outer periphery of the cylindrical member so that the outer periphery of the cylindrical member can easily be ground in a through-feed manner, for example, when a finish processing is carried out. Furthermore, since the rotation-preventing member is disposed so as to face an interior of the guide hole of the lifter guide and inserted into the engagement groove of the cylindrical member, the rotation-preventing member can easily be set to avoid entering a rotation locus of the cam. Consequently, since the cylindrical member is easily allowed to extend its length in the reciprocating direction, a sliding length or distance in the reciprocating direction can be increased.

DETAILED DESCRIPTION

First Embodiment

Figure 1:
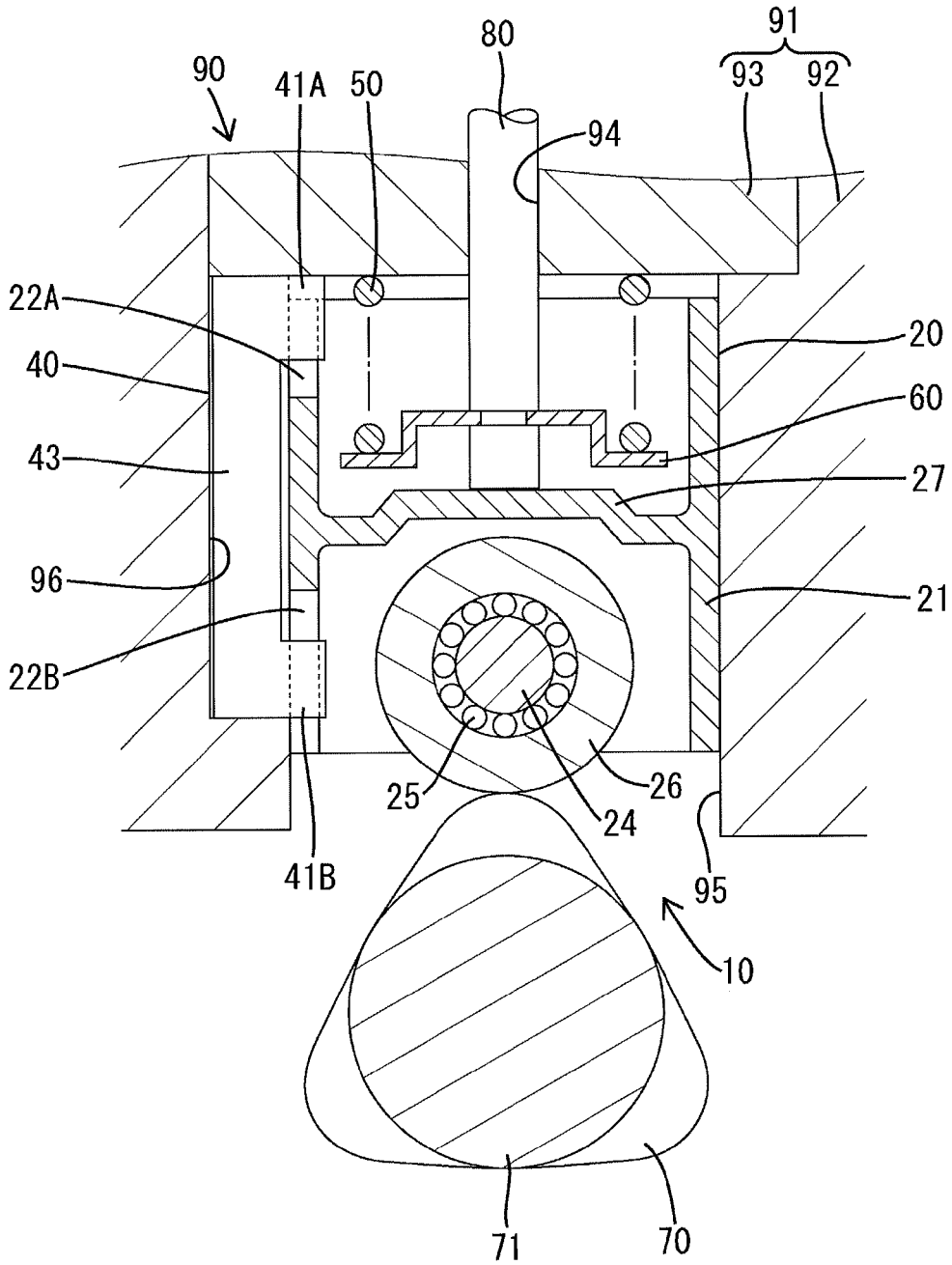
FIG. 1 is a cross sectional view of a pump lifter employing the lifter structure according to a first embodiment, showing the pump lifter incorporated in a lifter guide.

A first embodiment will be described with reference to FIGS. 1 and 2. The first embodiment presents the structure applied to a pump lifter 10 of a fuel supply system 90.

The fuel supply system 90 supplies fuel adjusted to be high-pressurized by the pump lifter 10 to a combustion chamber of an engine although not shown in detail in the drawings. The pump lifter 10 is incorporated in a lifter guide 91 of a cylinder head. The lifter guide 91 includes a housing 92 and a cover 93 fitted to an upper end of the housing 92, as shown in FIG. 1. The cover 93 is formed with a through hole 94 extending therethrough in an up-down direction and having a circular cross section. A plunger 80 is inserted through the hole 94 to be reciprocally slidable in the up-down direction. The plunger 80 has an upper end disposed to be allowed to come into and go out of a pressure chamber (not shown) communicating with an upper end of the hole 94. Fuel in the pressure chamber is pressurized when the upper end of the plunger 80 goes into the pressure chamber.

The housing 92 is formed with a guide hole 95 communicating with a lower end of the hole 94. The guide hole 95 has a larger diameter than the hole 94 and has a circular cross section. The guide hole 95 is shaped to extend in the up-down direction and to open in a lower end of the housing 92. The guide hole 95 has an upper end closed by the cover 93 fitted to the housing 92. The cylindrical member 20 is inserted into the guide hole 95 so as to be reciprocally slidable in the up-down direction (reciprocating direction).

The housing 92 is also formed with a retainer groove 96 which extends in the up-down direction and is open in an inner periphery of the guide hole 95 along the up-down direction. The retainer groove 96 has upper and lower ends both of which are closed. The upper end of the retainer groove 96 is closed by the cover 93. A rotation-preventing member 40 which will be described in detail later is retained in the retainer groove 96 of the lifter guide 91 thereby to be fixed thereto.

The cylindrical member 20 has a substantially cylindrical peripheral wall 21 extending in the up-down direction. The peripheral wall 21 has an outer periphery disposed along the inner periphery of the guide hole 95 so as to be slidable in the guide groove 95. The peripheral wall 21 has upper and lower edge which are continuous with a uniform level over a whole periphery except for openings of engagement grooves 22A and 22B, and the lower edge is extended as long as possible in a range outside a rotation locus of a cam 70 located below. More specifically, a sufficiently long up-down sliding distance of the peripheral wall 21 is ensured with the result that the cylindrical member 20 is structured to be unlikely to tilt in the guide hole 95.

Figure 2:
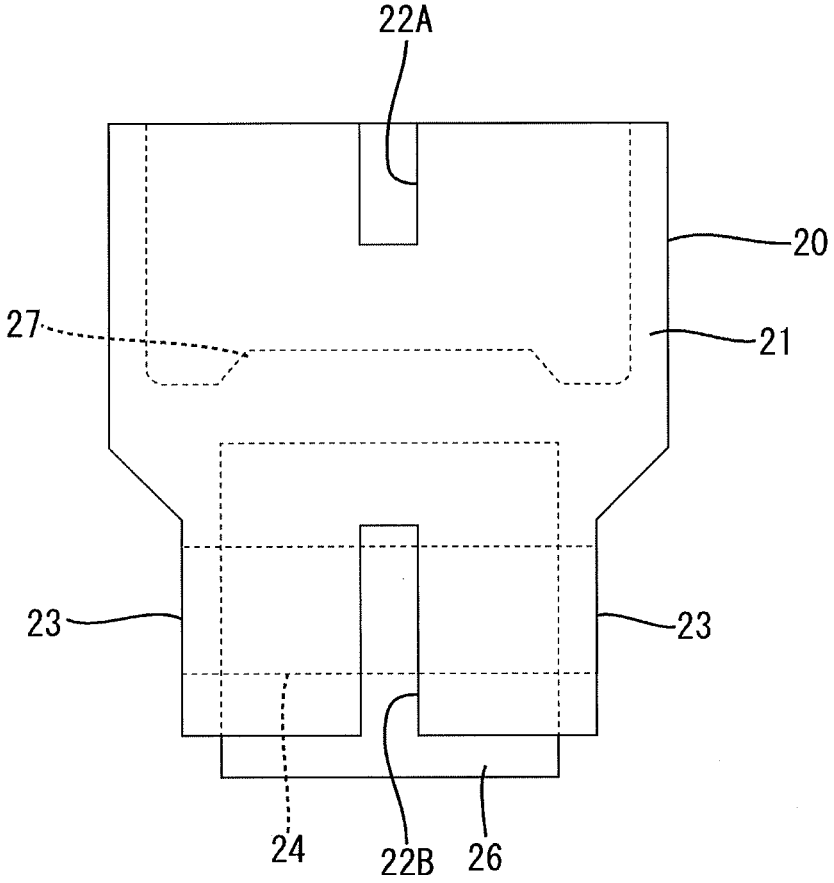
FIG. 2 is a side elevation of a cylindrical member.

The lower end of the peripheral wall 21 includes both radial ends (right and left ends in FIG. 2) formed with a pair of support walls 23 which are opposed substantially in parallel to each other, as shown in FIG. 2. A shaft member 24 has two ends supported on the support walls 23 respectively. A cylindrical roller 26 is rotatably mounted via a bearing 25 such as a needle bearing on the shaft member 24 as shown in FIG. 1. The roller 26 is disposed so that an outer periphery thereof is brought into sliding contact with the cam 70. The cam 70 is formed into a substantially triangular shape and mounted on a cam shaft 71. The cam shaft 71 is disposed so that an axis line thereof is parallel to an axis line of the shaft member 24.

The cylindrical member 20 includes a generally flat-plate shaped partition wall 27 extending radially (in a direction perpendicular to the up-down direction) inside the peripheral wall 21, as shown in FIG. 1. The partition wall 27 has an outer periphery connected integrally with an up-down middle part of the inner periphery of the peripheral wall 21. The cylindrical member 20 is divided into upper and lower spaces by the partition wall 27. The roller 26 is housed in the lower space located below the partition wall 27 of the cylindrical member 20. The roller 26 is disposed between the support walls 23 and a most part of the roller 26 except for a lower end thereof is housed in the cylindrical member 20.

A lower end of the plunger 80, a retainer 60 and a biasing member 50 are housed in the upper space of the cylindrical member 20 located above the partition wall 27. The retainer 60 is formed into a general disc shape, extending along the radial direction. The lower end of the plunger 80 is locked to a central part of the retainer 60 thereby to be fixed in position. The biasing member 50 is a spring member comprising a compression coil spring and has a lower end which abuts against an upper side of the retainer 60 thereby to be supported. The biasing member 50 has an upper end which abuts against an underside of the cover 93 of the lifter guide 91 thereby to be supported, with the result that the biasing member 50 is elastically expandable and contractable in the up-down direction. The biasing member 50 has a biasing force such that the cylindrical member 20 is biased to the cam 70 side and such that the roller 26 is pressed against the cam 70.

The engagement grooves 22A and 22B are formed through the peripheral wall 21 of the cylindrical member 20 as shown in FIG. 2. The engagement grooves 22A and 22B are located at up-down coaxial positions on the upper and lower ends of the peripheral wall 21 respectively. The upper engagement groove 22A extends in the up-down direction to be open at an upper end of the cylindrical member 20. The upper engagement groove 22A is formed to have a uniform width over an entire up-down dimension or length thereof. The upper engagement groove 22A has a lower end which is closed above the partition wall 27. Furthermore, the lower engagement groove 22B extends in the up-down direction to be open at the lower end of the peripheral wall 21 between the support walls 23 of the cylindrical member 20. The lower engagement groove 22B has the same groove width as the upper engagement groove 22A and is formed to have a uniform width over an entire up-down dimension or length thereof. The lower engagement groove 22B has an upper end which is closed below the partition wall 27. The rotation-preventing member 40 has two insertion portions 41A and 41B which are inserted in a non-press fitted state into the upper and lower engagement grooves 22A and 22B paired in the up-down direction, respectively.

The rotation-preventing member 40 is formed into a band plate shape and includes a connecting portion 43 extending in the up-down direction and the paired insertion portions 41A and 41B protruding sideways (in the direction perpendicular to the up-down direction) from upper and lower ends of the connecting portion 43 respectively, as shown in FIG. 1. The connecting portion 43 has an up-down dimension corresponding to the up-down dimension of the cylindrical member 20 and is fitted into the retainer groove 96 thereby to be held on the lifter guide 91.

The paired insertion portions 41A and 41B are disposed via the connecting portion 43 at a predetermined distance so as to be located at positions corresponding to the upper and lower ends of the cylindrical member 20 respectively. The insertion portions 41A and 41B have plate thicknesses set to be slightly smaller than the groove widths of the engagement grooves 22A and 22B respectively. As a result, the upper insertion portion 41A is inserted into the upper engagement groove 22A thereby to be engageable with the engagement grooves 22A, and the lower insertion portion 41B is inserted into the lower engagement groove 22B thereby to be engageable with the engagement grooves 22B. The insertion portions 41A and 41B change their positions relative to the engagement grooves 22A and 22B in the up-down direction respectively while the cylindrical member 20 is reciprocally slid in the guide hole 95.

Next, the assembly and working of the pump lifter 10 will be described. In the assembly of the pump lifter 10, the insertion portions 41A and 41B of the rotation-preventing member 40 are inserted into the corresponding engagement grooves 22A and 22B of the cylindrical member 20 respectively. In this state, the connecting portion 43 of the rotation-preventing member 40 is inserted into the retainer groove 96 from above. Subsequently, the cover 93 is fitted to the housing 92 from above. With this, the cover 93 abuts against the upper surface of the rotation-preventing member 40, so that the rotation-preventing member 40 is retained between the cover 93 and the housing 92 thereby to be fixed in position.

After the assembly, when the cam 70 is rotated via the cam shaft 71, the roller 26 is driven thereby. In this case, in a fuel suction stroke, the cylindrical member 20 is subjected to a biasing force of the biasing member 50 thereby to be pressed, so that the cylindrical member 20 is slid downward in the guide hole 95 and the plunger 80 is also slid downward in the same manner. As a result, the upper end of the plunger 80 is retreated from the pressure chamber. On the other hand, in a fuel discharge stroke, the cylindrical member 20 is slid upward in the guide hole 95 against the biasing force of the biasing member 50 and the plunger 80 is also slid upward in the same manner. As a result, the upper end of the plunger 80 enters the pressure chamber.

While the cylindrical member 20 is reciprocally slid in the guide hole 95, the rotation-preventing member 40 is retained in a fixed state to the retainer groove 96 and the insertion portions 41A and 41B are escaped in the up-down direction in the engagement grooves 22A and 22B of the cylindrical member 20 respectively. On the other hand, the insertion portions 41A and 41B abut against respective groove edges of the engagement grooves 22A and 22B in the circumferential direction (the rotation direction of the cylindrical member 20), so that the cylindrical member 20 is prevented from rotation with the result that a smooth reciprocal movement of the cylindrical member 20 is ensured.

According to the above-described first embodiment, the rotation-preventing member 40 is separate from the cylindrical member 20. Accordingly, the outer periphery of the peripheral wall 21 of the cylindrical member 20 can easily be ground continuously in a through-feed manner when a finish processing is carried out. Furthermore, the accuracy (the circularity) of the outer periphery of the peripheral wall 21 is improved. This can overcome defects such as production of abnormal noise due to the tilting of the cylindrical member 20 in the guide hole 95.

In particular, the rotation-preventing member 40 is fixed to the lifter guide 91, and the insertion portions 41A and 41B of the rotation-preventing member 40 are inserted into the respective engagement grooves 22A and 22B of the peripheral wall 21 in the non-press fitted state. Accordingly, the accuracy (the circularity) of the outer periphery of the peripheral wall 21 can further be improved since the peripheral wall 21 does not receive an excessive pressure from the rotation-preventing member 40. Consequently, the outer periphery of the cylindrical member 20 can smoothly be slid on the inner periphery of the guide hole 95 of the lifter guide 91.

Furthermore, since the rotation-preventing member 40 is separate from the cylindrical member 20, consideration need not be made to prevent the rotation-preventing member 40 from entering the rotation locus of the cam 70 when an overall length (sliding length) of the peripheral wall 21 of the cylindrical member 20 is set. Consequently, an entire length of the peripheral wall 21 can be set to a sufficiently large value, so that the cylindrical member 20 can further be prevented from tilting in the guide hole 95.

Still furthermore, the rotation-preventing member 40 includes the connecting portion 43 extending in the reciprocating direction (the up-down direction) of the cylindrical member 20 and the paired insertion portions 41A and 41B protruding in the direction perpendicular to the up-down direction from both ends of the connecting portion 43 respectively. The paired engagement grooves 22A and 22B are formed in the upper and lower ends of the peripheral wall 21 of the cylindrical member 20 so as to be located such that the insertion portions 41A and 41B are insertable into the engagement grooves 22A and 22B, respectively. Accordingly, since the cylindrical member 20 reciprocally slid in the guide hole 95 is stably maintained in an upright posture (a normal posture along the extending direction of the guide hole 95), the cylindrical member 20 can more reliably be prevented from being tilted in the guide hole 95.

Still furthermore, the lifter guide 91 includes the housing 92 and the cover 93 attached to the upper end surface of the housing 92. The housing 92 has the retainer groove 96 open in the upper end surface and the inner periphery of the guide hole 95. The rotation-preventing member 40 is inserted into the retainer groove 96, and the upper end opening of the retainer groove 96 is closed by the cover 93. As a result, since the rotation-preventing member 40 is prevented from dropping out of the retainer groove 96, the rotation-preventing member 40 can stably be retained on the lifter guide 91.

Still furthermore, the cylindrical member 20 has the cylindrical peripheral wall 21 formed with the engagement grooves 22A and 22B. The lower edge (the edge at the side where the cam 70 is located) of the peripheral wall 21 is continuous with the uniform level over the entire circumference except for the openings of the engagement grooves 22A and 22B. Consequently, a sufficient sliding movement region of the peripheral wall 21 can be ensured with the result that the tilting of the cylindrical member 20 can reliably be reduced.

Second Embodiment

Figure 3:
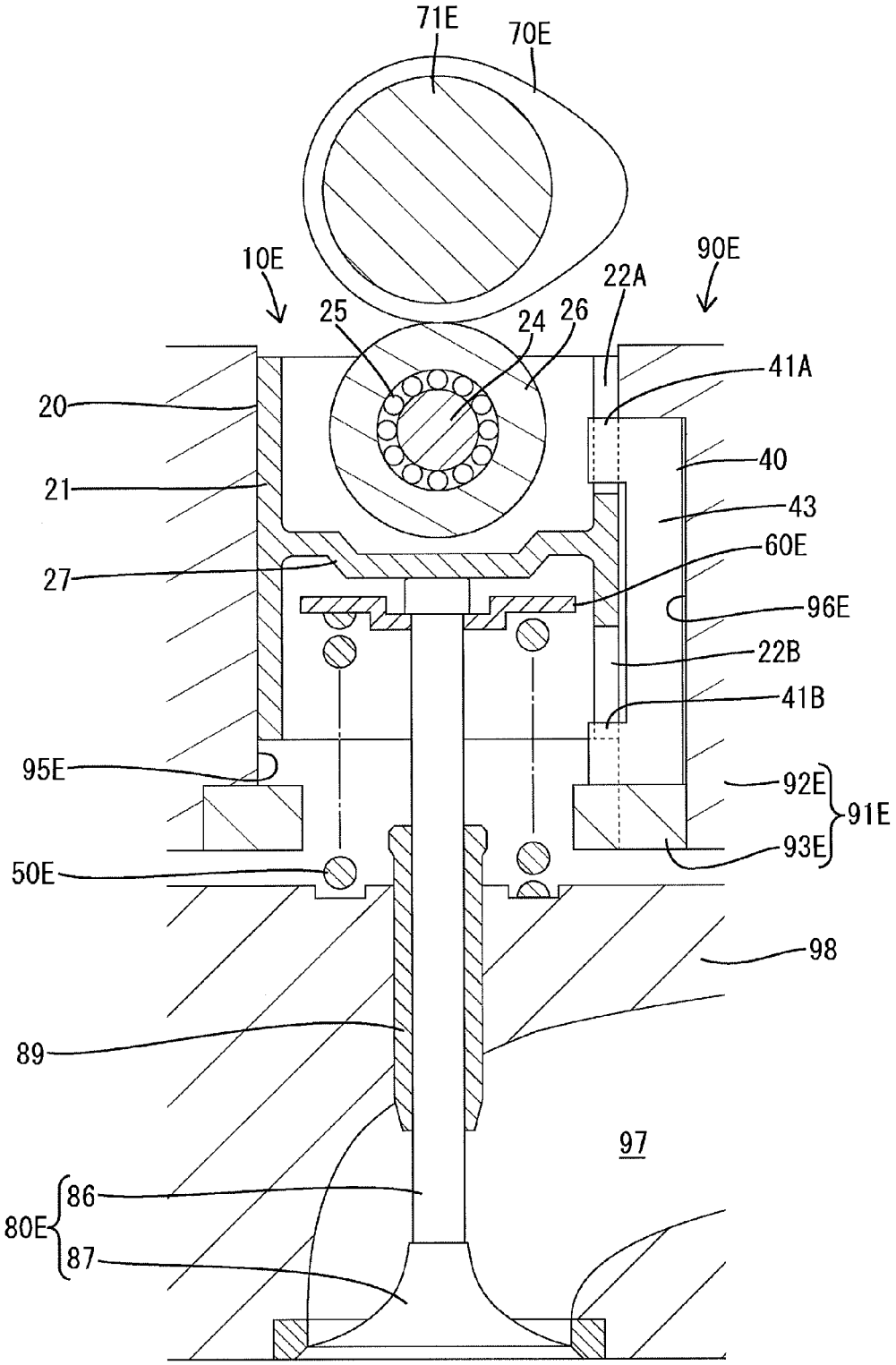
FIG. 3 is a cross sectional view of the valve lifter employing the lifter structure according to a second embodiment, showing the valve lifer incorporated into the lifter guide.

FIG. 3 shows a second embodiment. The second embodiment presents the structure applied to a valve lifter 10E of a valve gear 90E. The second embodiment has substantially the same lifter structure as the first embodiment.

The valve lifter 10E is disposed between the valve 80E and the cam 70E to serve to transmit a drive force of the cam 70E to the valve 80E. The valve lifter 10E includes the cylindrical member 20, the rotation-preventing member 40, the shaft member 24 and the roller 26 in the same manner as in the first embodiment. The roller 26 is brought into sliding contact with the cam 70E thereby to be rotatable. In the second embodiment, the cam 70E mounted on the cam shaft 71E is located above the lifter guide 91E upside down with respect to the disposition in the first embodiment.

The lifter guide 91E includes a housing 92E having a guide hole 95E and a retainer groove 96E and a cover 93E fitted to the housing 92E. The cover 93E is formed into a substantially annular shape and closes the lower end of the retainer groove 96E. The cover 93E maintains the rotation-preventing member 40 inserted into the retainer groove 96E so as to prevent the rotation-preventing member 40 from dropping out of the retainer groove 96E. A valve stem 86 of the valve 80E and the biasing member 50E are disposed inside the cover 93E.

The valve 80E includes the valve stem 86 and a valve body 87 protruding radially from a lower end of the valve stem 86. The valve body 87 faces an inlet or outlet 97 of the cylinder 98 to be capable of opening and closing the inlet or outlet 97. The valve stem 86 is slidably inserted into a cylindrical stem guide 89 assembled to the cylinder 98.

The valve stem 86 has an upper end which protrudes upward from the stem guide 89 and then enters the lower space of the cylindrical member 20 to be retained by the retainer 60E. The upper end of the valve stem 86 is in abutment against an underside of the partition wall 27 of the cylindrical member 20. The biasing member 50E is disposed between an upper surface of the cylinder 98 and the retainer 60E and has a biasing force pressing the roller 26 against the cam 70E.

When the cam 70E is rotated so that the cylindrical member 20 is downwardly pressed via the roller 26, the cylindrical member 20 is downwardly slid in the guide hole 95E against the biasing force of the biasing member 50E. This displaces the valve 80E downward with the result that the valve body 87 opens the inlet or outlet 97. When further rotation of the cam 70E reduces the pressing force from the cam 70E side, the cylindrical member 20 is displaced upward when having received the biasing force of the biasing member 50E, so that the valve body 87 closes the inlet or outlet 97. Thus, while the cylindrical member 20 is reciprocally slid in the guide hole 95E, the rotation-preventing member 40 is retained by the retainer groove 96E of the lifter guide 91E to be fixed therein and the insertion portions 41A and 41B are inserted into the respective engagement grooves 22A and 22B of the peripheral wall 21 of the cylindrical member 20 to be engaged therewith, in the same manner as in the first embodiment. This prevents the cylindrical member 20 from being rotated in the guide hole 95E. Since the cylindrical member 20 and the rotation-preventing member 40 are separate from each other and the rotation-preventing member 40 is inserted into the engagement grooves 22A and 22B in the non-press fitted state, the second embodiment can achieve the same advantageous effect as the first embodiment.

Other Embodiments

The foregoing first and second embodiments may be modified as follows.

(1) The rotation-preventing member may be a key-like member which has a substantially L- or T-shaped cross section as a whole and is provided with a single insertion portion. In this case, the cylindrical member is preferably structured to have a single engagement groove at a position corresponding to the insertion portion.

(2) The rotation-preventing member may be retained in the engagement grooves of the cylindrical member and may reciprocally be moved in the guide hole together with the cylindrical member.

(3) The engagement grooves may be formed into a closed loop without opening in the upper or lower end of the cylindrical member.

(4) The cam may directly be brought into sliding contact with the cylindrical member without via the roller.

What is claimed is:

1. A lifter structure comprising:

a cylindrical member configured to be reciprocally slid in a guide hole of a lifter guide according to rotation of a cam, the cylindrical member having a plurality of engagement grooves; and a rotation-preventing member which is separate from the cylindrical member and is disposed so as to face an interior of the guide hole, the rotation-preventing member being inserted into the engagement grooves to abut against groove edges of the engagement grooves in a rotation direction of the cylindrical member, thereby preventing the cylindrical member from rotation in the guide hole, wherein:

the rotation-preventing member is fixed to the lifter guide and includes:

a connecting portion extending in a reciprocating direction of the cylindrical member; and a pair of insertion portions respectively protruding from both ends of the connecting portion in a direction perpendicular to the reciprocating direction of the cylindrical member, the insertion portions being respectively insertable into the engagement grooves in a non-press fitted state; and the engagement grooves are paired at respective positions where the insertion portions are respectively insertable into the engagement grooves in two ends of the cylindrical member.

2. A lifter structure comprising:

a cylindrical member configured to be reciprocally slid in a guide hole of a lifter guide according to rotation of a cam, the cylindrical member having a plurality of engagement grooves; and a rotation-preventing member which is separate from the cylindrical member and is disposed so as to face an interior of the guide hole, the rotation-preventing member being inserted into the engagement grooves to abut against groove edges of the engagement grooves in a rotation direction of the cylindrical member, thereby preventing the cylindrical member from rotation in the guide hole, wherein:

the lifter guide has a housing formed with the guide hole and a cover attached to an end surface of the housing;

the housing is formed with a retainer groove which is open to the end surface of the housing and an inner periphery of the guide hole; and the rotation-preventing member is inserted into the retainer groove and an end surface opening of the retainer groove is closed by the cover, thereby being prevented from dropping out of the retainer groove.

3. The structure according to claim 2, wherein the rotation-preventing member is fixed to the lifter guide and is insertable into the engagement grooves in a non-press fitted state.

4. A lifter structure comprising:

a cylindrical member configured to be reciprocally slid in a guide hole of a lifter guide according to rotation of a cam, the cylindrical member having a plurality of engagement grooves; and a rotation-preventing member which is separate from the cylindrical member and is disposed so as to face an interior of the guide hole, the rotation-preventing member being inserted into the engagement grooves to abut against groove edges of the engagement grooves in a rotation direction of the cylindrical member, thereby preventing the cylindrical member from rotation in the guide hole, wherein:

the cylindrical member has a cylindrical peripheral wall formed with the engagement grooves; and the cylindrical peripheral wall of the cylindrical member has an edge which is continuous with a uniform level over a whole periphery except for an opening of one of the engagement grooves.

5. The structure according to claim 4, wherein the rotation-preventing member is fixed to the lifter guide and is insertable into the engagement grooves in a non-press fitted state.

* * * * *